US011278948B2

(12) United States Patent
Avrillaud et al.

(10) Patent No.: US 11,278,948 B2
(45) Date of Patent: Mar. 22, 2022

(54) ELECTROHYDRAULIC FORMING METHOD AND ASSOCIATED DEVICE

(71) Applicant: ADM28 S.ÀR.L, Luxembourg (LU)

(72) Inventors: Gilles Avrillaud, Pinsaguel (FR); Julien Fuzeau, Lille (FR)

(73) Assignee: ADM28 S.ÀR.L, Luxembourg (LU)

( * ) Notice: Subject to any disclaimer, the term of this patent is extended or adjusted under 35 U.S.C. 154(b) by 244 days.

(21) Appl. No.: 16/349,956

(22) PCT Filed: Nov. 14, 2017

(86) PCT No.: PCT/EP2017/079132

§ 371 (c)(1),
(2) Date: May 14, 2019

(87) PCT Pub. No.: WO2018/091436

PCT Pub. Date: May 24, 2018

(65) Prior Publication Data

US 2019/0299270 A1 Oct. 3, 2019

(30) Foreign Application Priority Data

Nov. 15, 2016 (FR) ..... 1661070

(51) Int. Cl.
*B21D 26/12* (2006.01)
*B21D 26/023* (2011.01)
(Continued)

(52) U.S. Cl.
CPC ..... *B21D 26/12* (2013.01); *B21D 26/021* (2013.01); *B21D 26/023* (2013.01); *B21D 26/031* (2013.01)

(58) Field of Classification Search
CPC ..... B21D 26/06; B21D 26/08; B21D 26/12; B21D 26/021; B21D 26/023; B21D 26/031; B21D 24/14; B21D 24/08
See application file for complete search history.

(56) References Cited

U.S. PATENT DOCUMENTS 3,358,487 A * 12/1967 Brejcha ..... B21D 26/12 72/56
3,742,746 A * 7/1973 Erlandson ..... B21D 26/08 72/56

(Continued)

FOREIGN PATENT DOCUMENTS

DE 100 19 594 A1 10/2001
WO WO-2015071869 A1 * 5/2015 ..... B21D 26/12

*Primary Examiner* — Teresa M Ekiert
(74) *Attorney, Agent, or Firm* — Seed Intellectual Property Law Group LLP

(57) ABSTRACT

A method for electrohydraulically forming a blank of material includes—a blank of material to be deformed is placed between a mould and a blank holder, —a cavity containing electrodes is filled with liquid to a predetermined liquid level, —the blank of material is placed in contact with the liquid in the cavity, —a first electric discharge is generated between at least two electrodes so as to deform the blank of material against the mould, —the mould is brought nearer to the electrodes by moving the mould so as to reduce the distance between the electrodes and the blank of material to be deformed after the first electric discharge has been generated, —at least one other electric discharge is generated between at least two electrodes so as to deform the blank of material against the mould.

11 Claims, 4 Drawing Sheets

(51) Int. Cl.
*B21D 26/021* (2011.01)
*B21D 26/031* (2011.01)

(56) References Cited

U.S. PATENT DOCUMENTS

| | | | | |
|---|---|---|---|---|
| 7,827,838 | B2 * | 11/2010 | Golovashchenko ... | B21D 26/12 72/56 |
| 8,844,331 | B2 | 9/2014 | Golovashchenko | |
| 9,937,547 | B2 | 4/2018 | Avrillaud et al. | |
| 2011/0088442 | A1 | 4/2011 | Golovashchenko | |
| 2014/0186481 | A1 | 7/2014 | Lee et al. | |

* cited by examiner

ELECTROHYDRAULIC FORMING METHOD AND ASSOCIATED DEVICE

BACKGROUND OF THE INVENTION

The present invention relates to an electrohydraulic forming method and an electrohydraulic forming device.

PURPOSE AND SUMMARY OF THE INVENTION

Electrohydraulic forming is used to deform a blank of material against a mould by applying a dynamic pressure. For this purpose, an electric discharge is generated between at least two electrodes in a cavity filled with liquid, for example water. An electric arc is thus formed between the two electrodes resulting in an elevated temperature gradient and vaporisation of the liquid. A pressure wave, commonly referred to as a "shock wave", moves at a high speed and presses the blank of material against the mould. Electrohydraulic forming is particularly advantageous compared to other forming methods since it produces a reduced springback and procures engraving type details and/or sharp edges and/or improved elongations at break on the parts to be formed.

In some cases, in particular when the parts to be formed are particularly deep, a plurality of successive electric discharges are produced. After each discharge, the blank of material moves away from the electrodes. The pressure wave thus propagates over a larger distance, which reduces the performance of the impact and the efficiency of the method.

Patent document U.S. Pat. No. 8,844,331 proposes overcoming this problem by bringing the electrodes nearer the blank of material after each discharge and before each new discharge by moving the electrodes. In this document, the electrodes are mounted on a moveable portion of the cavity. As a result of the high voltages used to generate an electric discharge between the electrodes, the current-carrying conductors connecting the electrodes to the voltage pulse generators are heavy, bulky and tend to deteriorate from being moved repeatedly. Currents of about several tens or hundreds of kA flow through these current-carrying conductors. The device proposed by the patent document U.S. Pat. No. 8,844,331 for allowing the electrodes to move, and thus allowing for the partial movement of the current-carrying conductors powering them is therefore relatively complex, bulky and creates reliability issues.

The present invention in particular aims to overcome the aforementioned drawbacks of the prior art.

To this end, the present invention proposes, according to a first aspect, an electrohydraulic forming method wherein:

- a blank of material to be deformed is placed between a mould and a blank holder,
- a cavity containing electrodes is filled with liquid to a predetermined liquid level,
- the blank of material is placed in contact with the liquid in the cavity,
- a first electric discharge is generated between at least two electrodes so as to deform the blank of material against the mould, characterised in that:
- the mould is brought nearer to the electrodes by moving the mould so as to reduce the distance between the electrodes and the blank of material to be deformed after the first electric discharge has been generated,

- at least one other electric discharge is generated between at least two electrodes so as to deform the blank of material against the mould.

In the method according to the invention, the mould is moved and the cavity remains stationary. Thus, the current-carrying conductors connecting the high-voltage generator to the electrodes are not moved, which tends to limit the deterioration thereof.

In one embodiment, one or more other electric discharges are generated when bringing the mould nearer the electrodes.

The mould can thus be moved in a continuous manner at the same time as successive electric discharges are generated. In this manner, the number of discharges generated in a given cycle time is increased. It should be noted that the speed at which the mould is moved is not necessarily constant, and that the electric discharges can take place at time intervals that lie in the range of one hundredth of a second to several seconds, as a function of the movement speed, the complexity of the part to be formed and the high-voltage electric pulse generator used.

In order to achieve such time intervals between each electric discharge, the high-voltage pulse generator can comprise a plurality of modules connected to one or more pairs of electrodes. If the electrohydraulic forming device comprises a single pair of electrodes, the different modules connected to the same pair of electrodes can be activated in order to generate the successive discharges. If the electrohydraulic forming device comprises a plurality of pairs of electrodes, the modules connected to the different pairs of electrodes can be activated successively or simultaneously. If activated simultaneously, a larger shock wave can be generated.

Advantageously, a vacuum is created between the blank of material and the mould. The efficiency of the electrohydraulic forming operation is thus improved.

According to a second aspect, the present invention proposes an electrohydraulic forming device capable of being used to implement the method according to the invention, comprising:

- a cavity capable of being filled with a liquid,
- at least two electrodes placed inside the cavity,
- a frame,
- a mould mounted on a plate, capable of moving towards the electrodes, the plate being mounted such that it can move relative to the frame, The electrohydraulic forming device according to the invention further comprises a blank holder capable of holding the blank of material to be deformed against the mould when the mould is moving, the blank holder being placed inside the frame.

By having a movable mould, while the electrodes and the cavity are stationary, the current-carrying conductors are not moved, which tends to limit the deterioration thereof. The device according to the invention is therefore more robust and reliable.

Moreover, there is no need to empty the cavity between two electric discharges or to add water between each discharge. In this case, only the distance between the mould and the electrodes requires adjusting. This thus results in reduced liquid consumption and above all in reduced cycle times for the manufacture of a part.

Moreover, the device comprises a vacuum pump.

The vacuum pump creates the vacuum between the mould and the blank of material in order to improve the efficiency of the electrohydraulic forming operation.

In one embodiment, the blank holder extends longitudinally towards the electrodes and at least partly surrounds the electrodes.

The blank holder acts as a reflector and improves the efficiency of the forming operation. The blank holder further prevents the shock waves from propagating towards the walls of the cavity or of the frame and prevents the deterioration thereof, in particular at the welds if comprising a mechanically welded structure.

In one embodiment, the cavity is at least partly formed by the frame.

If the cavity is formed inside the frame, the device is less complex and less bulky.

In one embodiment, the electrodes are supported by a baseplate resting on a bottom wall of the frame, the cavity thus being delimited by the baseplate and by the blank holder.

The volume of the cavity is reduced, which results in lower liquid consumption and the faster filling of the cavity.

In one embodiment, the blank holder is fixed to the mould.

This device is particularly advantageous when looking to fix parts having small dimensions for which the absorption or pressure exerted by the blank holder does not need to be controlled, the absorption in this case being low.

In one embodiment, the blank holder is mounted on at least one cylinder, a first end of each cylinder being fixed to the bottom wall of the frame, a second end of each cylinder being fixed to the blank holder.

The positioning of the blank of material to be formed between the mould and the blank holder is made easier since the blank of material to be deformed is deposited on the blank holder. The mould is then lowered until it comes into contact with the blank of material. The pressure exerted by the blank holder on the blank of material can be chosen and regulated by controlling the pressure exerted by the cylinder.

In one specific embodiment, the at least one cylinder is a gas spring.

The pressure exerted on the blank of material is thus constant, regardless of the position of the mould in the frame, as long as the mould is in contact with the blank of material.

In one embodiment, the electrohydraulic forming device comprises a cylindrical reflector placed between the electrodes and the side wall of the frame, preferably between the electrodes and the blank holder.

Advantageously, the cylindrical reflector has a cross-section (that is circular, elliptical, square, etc.) that is suited to that of the part to be formed. Such a reflector improves the efficiency of the forming operation and prevents the shock waves from propagating towards the walls of the cavity or of the frame and prevents the deterioration thereof, in particular at the welds if the cavity or frame have a mechanically welded structure.

BRIEF DESCRIPTION OF THE FIGURES

The features and advantages of the present invention will be more clearly observed in the following description, which is given with reference to the accompanying figures, in which.

DETAILED DESCRIPTION OF SEVERAL EMBODIMENTS OF THE INVENTION

Figure 1:
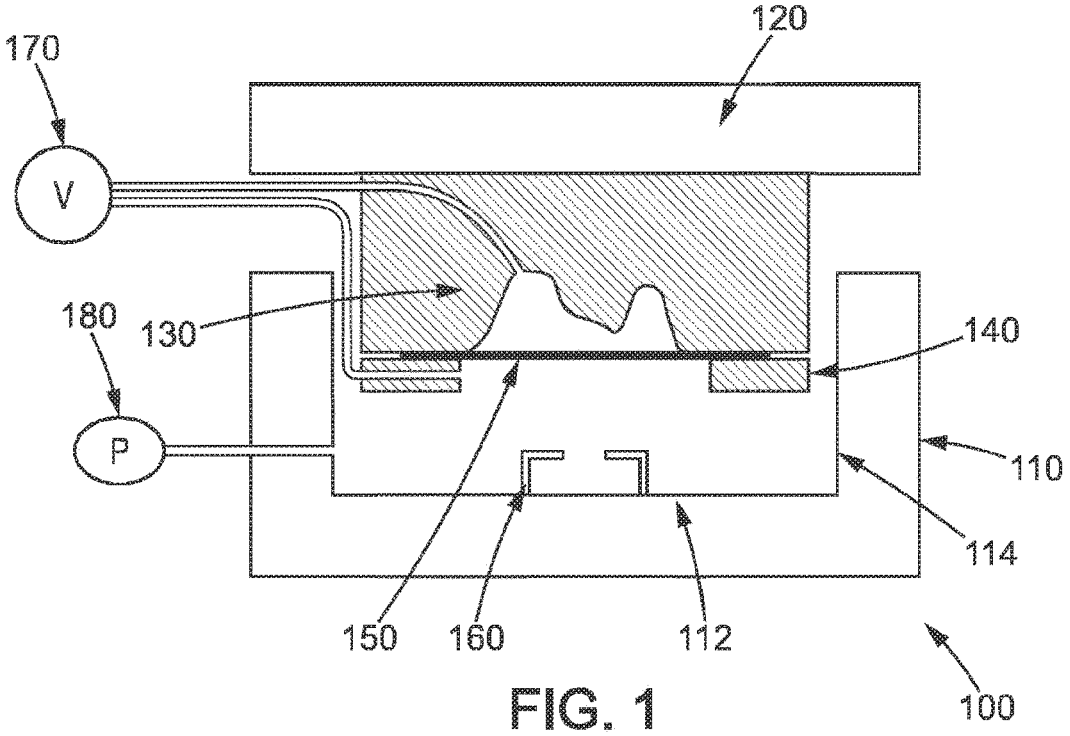
FIGS. 1 to 4 show different steps of an electrohydraulic forming method according to the invention, the method being implemented with an electrohydraulic forming device according to a first embodiment.

FIG. 1 shows an electrohydraulic forming device 100 according to a first embodiment. This electrohydraulic forming device 100 comprises a frame 110 and a plate 120 on which a mould 130 is mounted. The plate 120, and thus the mould 130 are capable of moving relative to the frame 110. The plate 120 is mounted on a press rigidly secured to the frame 110.

A blank of material 150 to be deformed is placed between the mould 130 and a blank holder 140. In the embodiment described here, the blank holder 140 is fixed to the mould 130. The frame 110 comprises a bottom wall 112 and a side wall 114. The bottom wall 112, the side wall 114 and the edges of the blank holder 140 define a cavity intended to be filled with a liquid, for example water. A pumping circuit associated with a pump 180 is used to fill the cavity with liquid. A vacuum pump 170 is used to create a vacuum in the space between the mould 130 and the blank of material 150 to be deformed and inside the cavity, more particularly in the space that lies between the blank of material 150 and the blank holder 140. At least two electrodes 160 are mounted on the bottom wall 112, said electrodes being connected to current-carrying conductors which can, for example, be insulated metal plates or cables (not shown in the figures). These current-carrying conductors can be connected to an electric generator used to generate high-voltage pulses that are sufficient for causing an electric discharge between two electrodes 160. The current-carrying conductors can pass, in a sealed manner, through the walls of the frame or pass over the edges of the walls of the frame.

In an alternative embodiment, one of the electrodes is formed by the bottom wall 112.

Different steps of an electrohydraulic forming method using the above device are described with reference to FIGS. 1 to 4.

In a first step, the blank of material 150 to be deformed is placed between the mould 130 and the blank holder 140, and the blank holder 140 is clamped against the blank of material 150, for example using screws. The cavity containing the electrodes 160 is filled with liquid to a predefined level. Then, the lower portion of the blank holder 140 is placed in contact with the liquid in the cavity, for example either by bringing the mould 130 nearer the electrodes 160 by moving the mould 130, or by refilling the cavity. A vacuum is then created between the blank holder 140 and the blank of material 150. The filling of the cavity with the liquid then continues until the liquid is in contact with the blank of material 150. A vacuum is then created between the blank of material 150 and the mould 130.

Figure 2:
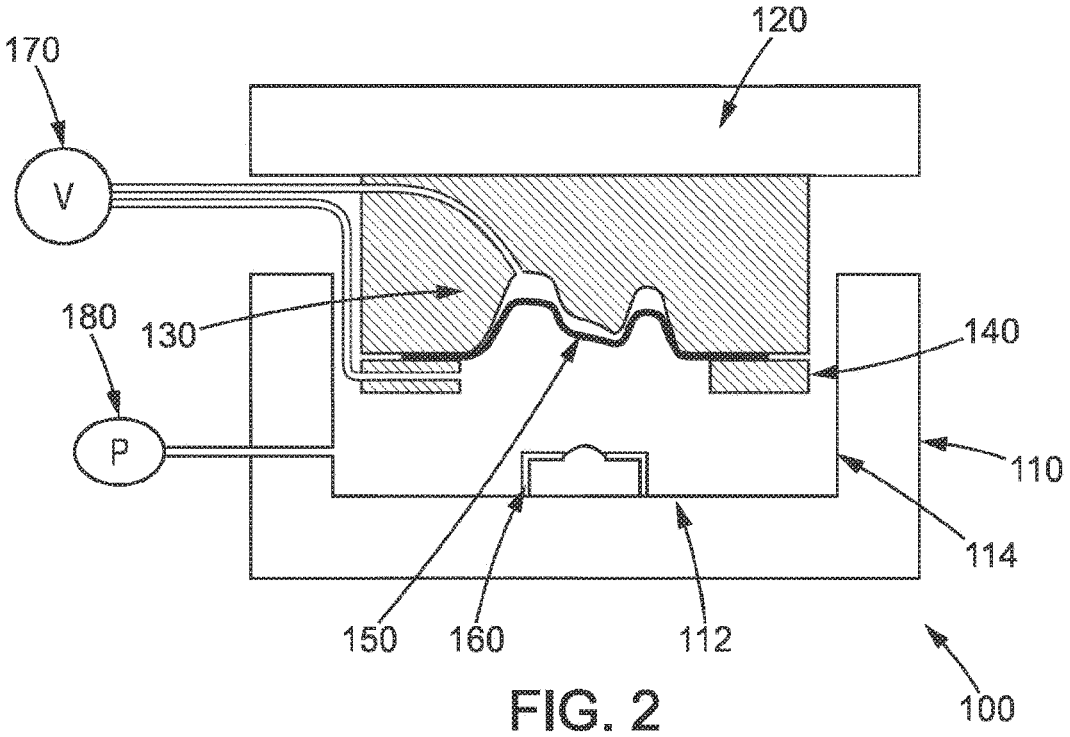

In a second step, a first electric discharge is generated between the two electrodes 160 so as to create an electric arc between the electrodes. Since the two electrodes 160 are immersed in a liquid, for example water, the electric arc produces an elevated temperature gradient until the water is vaporised between the electrodes 160. This vaporisation causes a pressure wave, also referred to as a "shock wave" hereafter, propagating in the liquid until it reaches the blank of material 150 to be deformed. Under the effect of the shock wave, the blank of material is deformed against the mould as shown in FIG. 2.

Figure 3:
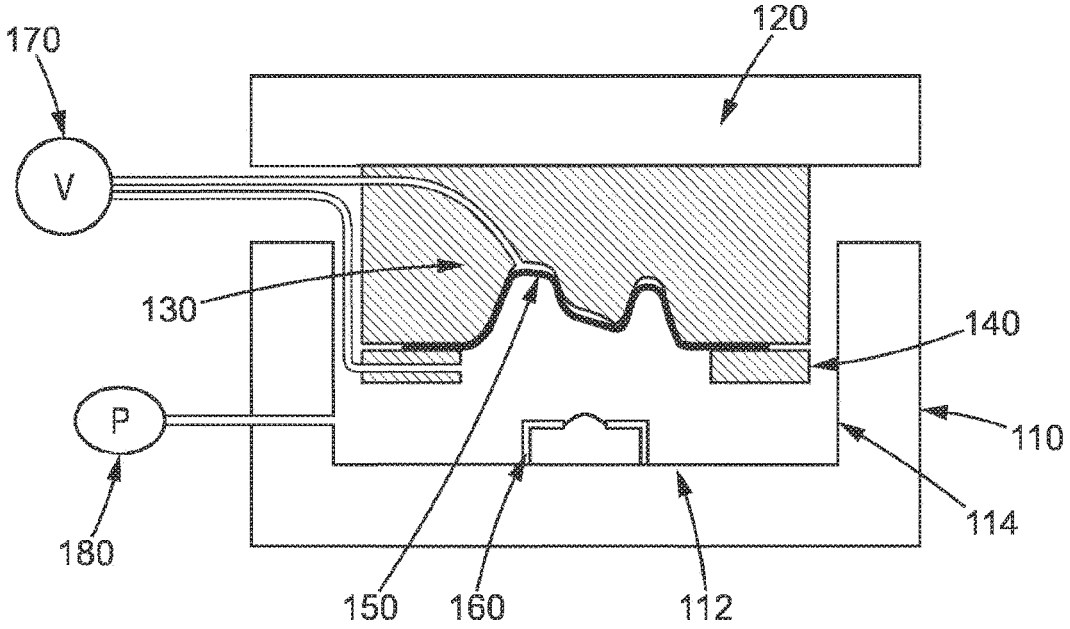
Figure 4:
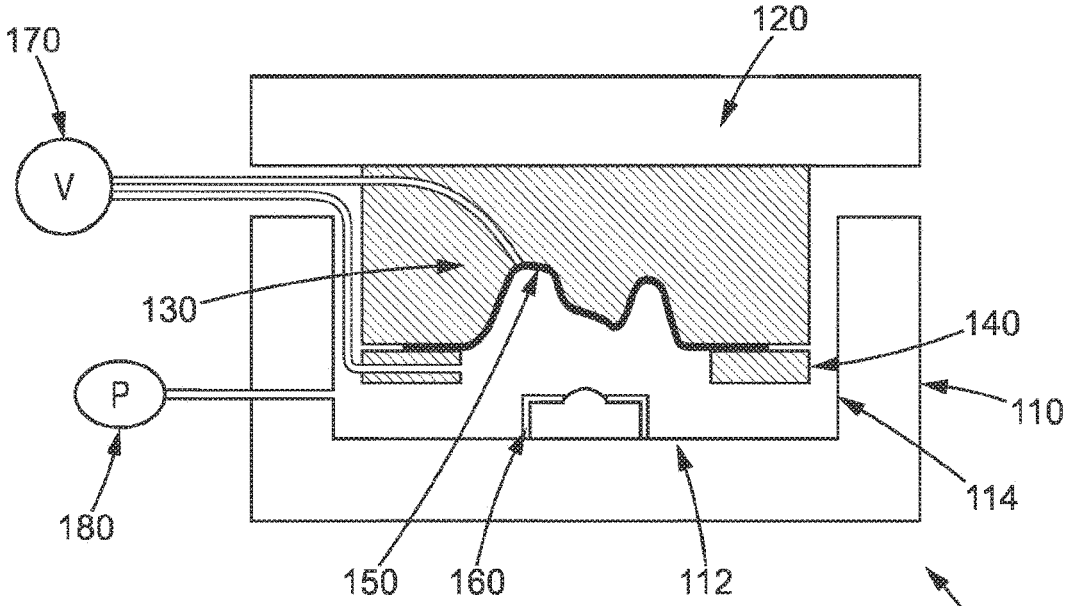

In a third step, the mould 130 is brought nearer the electrodes 160 by moving the mould 130 so as to reduce the distance between the blank of material and the electrodes as shown in FIG. 3. Another electric discharge is then generated between the two electrodes 160 as shown in FIG. 4. The blank of material is again pressed against the mould 130 by a new shock wave and the shape thereof further resembles that of the mould. If necessary, this third step is repeated as many times as necessary until the desired shape is reached.

It should be noted that the electric discharges generated between the electrodes 160 can be generated while the mould 130 is being brought nearer the electrodes by the continuous movement thereof, or after the mould 130 has been brought nearer the electrodes by the movement thereof up to a predetermined distance according to a sequential approach. If the mould 130 is brought nearer the electrodes by a continuous movement, the speed at which the mould is moved is not necessarily constant, and the electric discharges can take place at time intervals that lie in the range of one hundredth of a second to several seconds, as a function of the movement speed, the complexity of the part to be formed and the high-voltage electric pulse generator used.

In order to achieve such time intervals between each electric discharge, the high-voltage pulse generator can comprise a plurality of simultaneously-charged modules capable of being simultaneously and/or successively discharged.

In one alternative embodiment, the different modules are connected to a single pair of electrodes and can be activated successively in order to generate the successive discharges.

In another alternative embodiment, the electrohydraulic forming device comprises a plurality of pairs of electrodes, and the modules connected to the different pairs of electrodes can be activated successively or simultaneously. If activated simultaneously, a larger shock wave can be generated.

It should be noted that by bringing the mould 130 nearer the electrodes 160 between each successive electric discharge, by moving the mould 130, the efficiency of the electrohydraulic forming operation procured by each electric discharge is improved. More specifically, given that the blank of material is deformed after each new discharge, with a stationary mould and electrodes, the shock wave must travel a greater distance in order to reach the blank of material and thus loses intensity.

Figure 5:
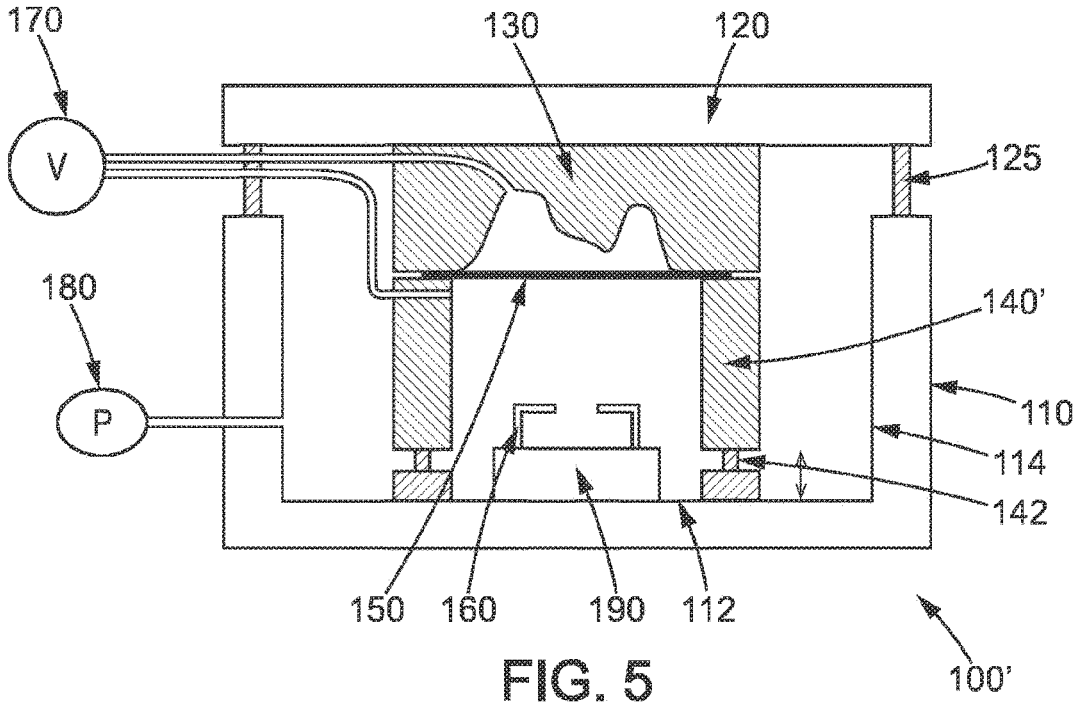
FIG. 5 shows an electrohydraulic forming device according to one alternative embodiment.

FIG. 5 shows one alternative embodiment of the device described with reference to FIG. 1. Most of the elements of this alternative embodiment are identical to those described hereinabove. Compared to the embodiment in FIGS. 1 to 4, the presence of setting and centring pins 125, for example, can be seen. The setting and centring pins 125 are used to guide the movement of the plate 120 when the plate 120 is mounted on a press that is separated from the frame 110. The setting and centring pins 125 allow the movement of the plate 120 relative to the blank holder 140 to be guided such that the lower surface of the mould 130 bears against the upper surface of the blank holder 140'. It is also used to limit the maximum height of the variation of the plate in order to control the minimum distance between the electrodes and the blank of material.

In the device 100' shown with reference to FIG. 5, the electrodes 160 are arranged away from the bottom wall 112, for example, by being mounted on a base plate 190. Alternatively, each of the electrodes or each pair of electrodes could be supported by an individual arm (not shown here).

Moreover, the blank holder 140' extends longitudinally towards the electrodes 160. The blank holder 140' is mounted on one or more cylinders, preferably on three cylinders 142 which can, by way of example, be gas springs. One of the ends of each cylinder is fixed to the bottom wall 112 of the frame and the other end thereof is fixed to the blank holder 140'. The pressure of the cylinder or of the gas spring is managed so as to be able to control the pressure of the blank holder exerted on the blank of material 150, regardless of the position of the mould 130 inside the cavity. Given that the blank holder 140' is not fixed to the mould as in the previous example, the blank of material 150 to be deformed is simply placed on the blank holder 140', and the mould 130 is then lowered such that it comes into contact with the blank of material 150 in order to hold the blank of material against the mould 130.

In this alternative embodiment, the hydraulic forming method is thus similar to that described with reference to FIGS. 1 to 4. However, the blank of material 150 is no longer held against the mould 130 using a blank holder 140 screwed onto the mould 130. In this alternative embodiment, the blank of material 150 to be deformed is deposited on the blank holder 140', then the mould 130 is lowered in order to press against the blank of material 150 and the blank holder 140'.

Advantageously, if the blank holder 140' at least partly surrounds the electrodes 160, the shock waves are reflected by the blank holder and confined in the space delimited by the blank holder inside the cavity. The propagation of the shock waves towards the frame is thus attenuated and the efficiency thereof to deform the blank of material 150 is improved.

Figure 6:
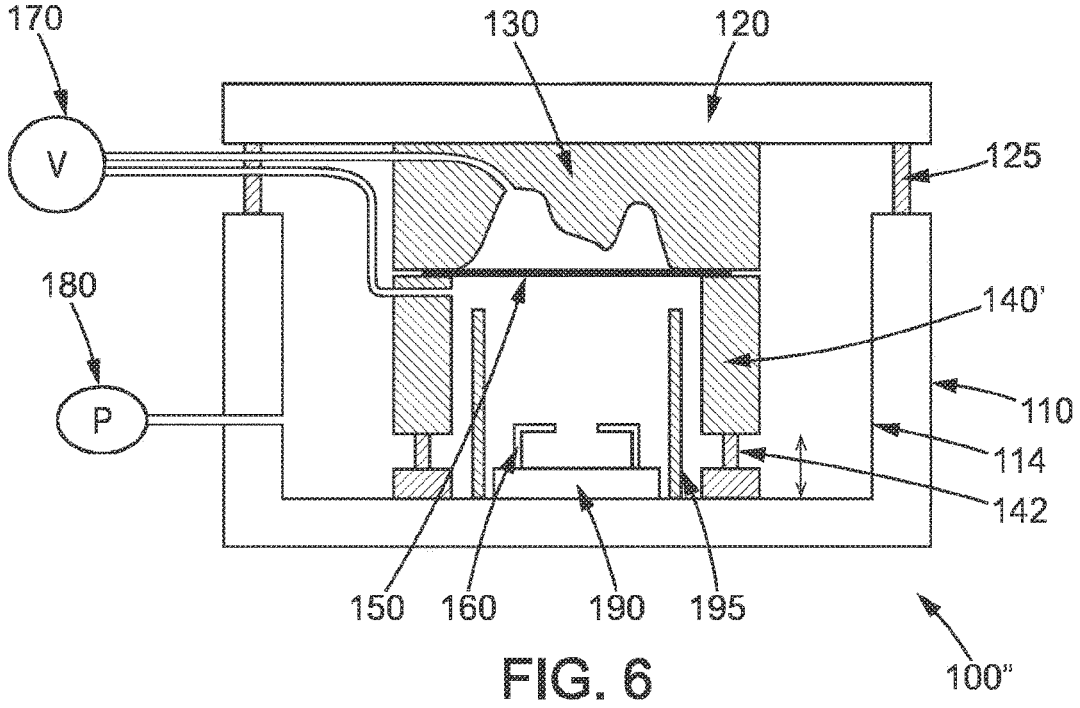
FIG. 6 shows an electrohydraulic forming device according to another alternative embodiment.

FIG. 6 shows another alternative embodiment, wherein a cylindrical tube 195, hereafter referred to as the ferrule, preferably having a cross-section suited to the shape of the part, is placed between the electrodes 160 and the blank holder 140', so as to surround the electrodes 160. This ferrule 195 acts as a reflector reflecting the pressure waves generated by the electric discharge between the electrodes 160.

The ferrule 195 can also be placed between the blank holder 140 and the side wall 114 of the frame in the embodiment in FIGS. 1 to 4 in order to reflect the shock waves propagating towards the frame 110.

Figure 7:
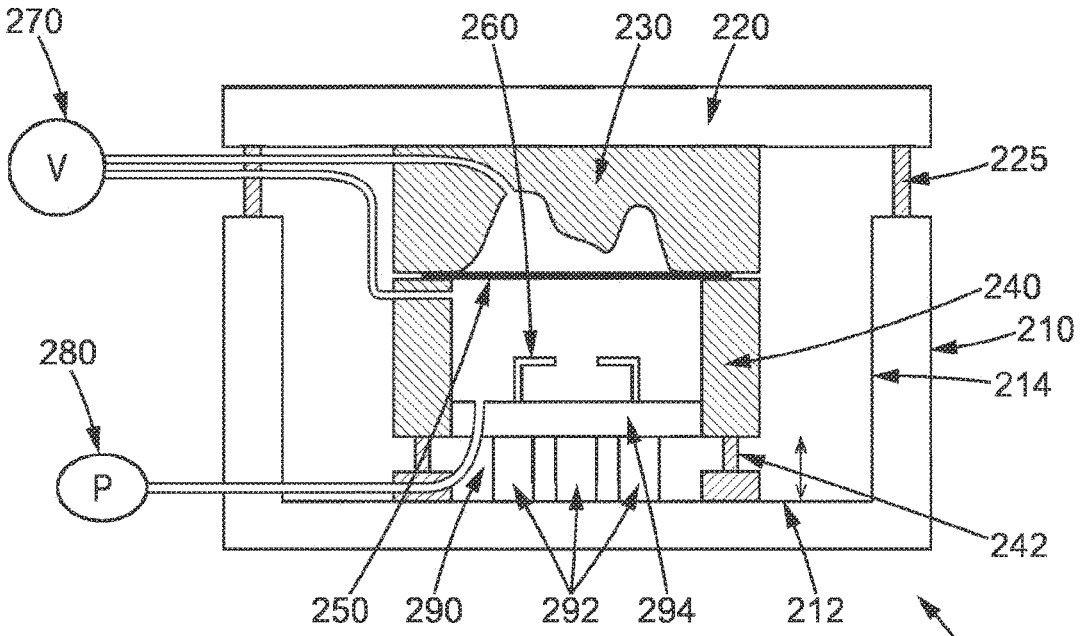
FIG. 7 shows an electrohydraulic forming device according to a second embodiment.

FIG. 7 shows a second embodiment of an electrohydraulic forming device 200 that comprises, as in the first embodiment, a frame 210, a moving plate 220 on which a mould 230 is mounted, and a blank holder 240 intended to hold the blank of material 250 to be deformed against the mould 230. Setting and centring pins 225 similar to those described with reference to FIG. 5 are provided between the frame 210 and the moving plate 220 in order to guide the movement of the plate 220 when the plate 220 is moved using a press separated from the frame 210 or using a hydraulic cylinder situated above the plate 220.

The frame 210 comprises a bottom wall 212 and a side wall 214. The blank holder 240 extends longitudinally parallel to the side wall 214 of the frame 210. The blank holder 240 is mounted on one or more cylinders 242, preferably on three cylinders, which cylinders can be, for example, gas springs. One end of each of these cylinders 242 is fixed to the bottom wall 212 of the frame and the other end is fixed to the blank holder 240. The electrodes 260 are mounted on a baseplate 290 comprising, for example, three legs 292 supporting a base 294. The electrodes 260 are connected, in a sealed manner, through the base 294, at least one leg 292 and the bottom wall 212 of the frame, to an electric generator used to generate short high-voltage pulses of a high electrical power and sufficient to generate an electrical discharge between two electrodes 160. The baseplate 290, and more particularly the base 294 thereof, the blank holder 240 and the blank of material 250 define a cavity intended to be filled with a liquid, for example water.

A pumping circuit associated with a pump 280 is used to fill the cavity with liquid. Such a cavity has the advantage of being capable of being filled in an optimised manner with a smaller volume of liquid compared to a similar device of the prior art. Moreover, the blank holder 240 is used to reflect a part of the shock wave generated after the electric discharge triggered between the electrodes, which limits the solicitation of the frame. More specifically, if the frame is frequently solicited by the shock waves, it can become fragile, in particular at the level of the welds between the different portions thereof if the frame has a mechanically welded structure. Thus, a frame with walls of a lesser thickness can be used.

In a first step, shown in FIG. 7, the blank of material 250 to be deformed is placed between the mould 230 and the blank holder 240 by depositing the blank of material 250 on the blank holder 240, then the mould 230 is lowered such that it comes into contact with the blank of material 250. The pressure exerted on the blank of material 250 by the blank holder 240 is controlled by the one or more cylinders 242, for example by the gas springs. The cavity containing the electrodes 260 is then filled with liquid using the pump 280, while also creating a negative pressure in the cavity using the vacuum pump 270. The negative pressure created facilitates the filling of the cavity and furthermore reduces the quantity of air present in the cavity and thus improves the efficiency of the electrohydraulic forming operation. The cavity is filled until the blank of material 150 comes into contact with the liquid in the cavity. A vacuum is then created between the blank of material 250 and the mould 230 using the pump 270.

Electric discharges are then generated between the electrodes and the mould is brought nearer the electrodes by moving the mould between each electric discharge as described hereinabove, in particular with reference to FIGS. 2, 3 and 4.

The various embodiments of an electrohydraulic forming device and the forming methods described hereinabove improve the forming efficiency procured by the electric discharges between the electrodes by adapting the distance between the electrodes and the blank of material to be deformed. The fact that the mould is moved relative to the electrodes simplifies the structure of the device compared to a device wherein the electrodes are moved, since only the mechanical elements must be moved and the electrical connections remain stationary.

The present invention is not limited to the different embodiments described and shown and to the alternative embodiments mentioned; it also relates to the embodiments within reach of a person skilled in the art within the scope of the claims hereafter.

The invention claimed is:

1. An electrohydraulic forming method, comprising:

placing a blank of material to be deformed between a mould and a blank holder, the blank holder disposed inside a frame and mounted on at least one cylinder, a first end of each cylinder fixed to a bottom wall of the frame, a second end of each cylinder fixed to the blank holder, the mould mounted on a plate that is movable relative to the frame;

filling with liquid a cavity containing electrodes to a predetermined liquid level;

placing the blank of material in contact with the liquid in the cavity;

generating a first electric discharge between the electrodes so as to deform the blank of material against the mould;

after generating the first electric discharge, moving the mould nearer to the electrodes so as to reduce the distance between the electrodes and the blank of material, wherein the blank holder holds the blank of material during the moving the mould nearer to the electrodes; and generating at least one other electric discharge between the electrodes so as to deform the blank of material against the mould.

2. The electrohydraulic forming method according to claim 1, wherein generating the at least one other electric discharge includes generating the at least one other electric discharge when moving the mould nearer the electrodes.

3. The electrohydraulic forming method according to claim 1, further comprising creating a vacuum between the blank of material and the mould.

4. An electrohydraulic forming device for electrohydraulically forming a blank of material comprising:

a cavity capable of being filled with a liquid;

at least two electrodes placed inside the cavity;

a frame;

a mould mounted on a plate and capable of moving towards the electrodes, the plate being configured to move relative to the frame;

a blank holder configured to hold the blank of material to be deformed against the mould when the mould is moving, the blank holder being placed inside the frame; and at least one cylinder on which the blank holder is mounted, a first end of each cylinder being fixed to a bottom wall of the frame, a second end of each cylinder being fixed to the blank holder.

5. The electrohydraulic forming device according to claim 4, further comprising a vacuum pump configured to create a vacuum between the blank of material and the mould.

6. The electrohydraulic forming device according to claim 4, wherein the blank holder extends longitudinally towards the electrodes and at least partly surrounds the electrodes.

7. The electrohydraulic forming device according to claim 4, wherein the cavity is at least partly formed by the frame.

8. The electrohydraulic forming device according to claim 4, further comprising a baseplate that supports the electrodes, the cavity thus being delimited by the baseplate and by the blank holder.

9. The electrohydraulic forming device according to claim 4, wherein the blank holder is fixed to the mould.

10. The electrohydraulic forming device according to claim 4, wherein each of the at least one cylinder is a gas spring.

11. The electrohydraulic forming device according to claim 4, further comprising a cylindrical reflector placed between the electrodes and a side wall of the frame.

* * * * *